United States Patent [19]

Buchheit

[11] Patent Number: 4,753,097

[45] Date of Patent: Jun. 28, 1988

[54] UNIVERSAL ROLL STAND

[75] Inventor: Otto K. Buchheit, St. Ingbert, Fed. Rep. of Germany

[73] Assignee: Mannesmann AG, Duesseldrof, Fed. Rep. of Germany

[21] Appl. No.: 926,635

[22] Filed: Nov. 3, 1986

[30] Foreign Application Priority Data

Nov. 2, 1985 [DE] Fed. Rep. of Germany ..... 3538905

[51] Int. Cl.[4] ..... B21B 13/10; B21B 31/04; B21B 31/08

[52] U.S. Cl. ..... 72/225; 72/238; 72/239

[58] Field of Search ..... 72/225, 237, 238, 239

[56] References Cited

U.S. PATENT DOCUMENTS

| | | | |
|---|---|---|---|
| 3,802,242 | 4/1974 | Svagr | 72/225 |
| 3,899,910 | 8/1975 | Aramaki | 72/225 X |
| 4,399,680 | 8/1983 | Hartmann et al. | 72/225 |
| 4,552,007 | 11/1985 | Mantovan | 72/239 |
| 4,577,130 | 12/1985 | Bond | 72/225 |
| 4,653,304 | 3/1987 | Feldmann et al. | 72/239 |

FOREIGN PATENT DOCUMENTS

| | | | |
|---|---|---|---|
| 2137911 | 10/1984 | United Kingdom | 72/225 |

*Primary Examiner*—Robert L. Spruill
*Assistant Examiner*—Steve Katz
*Attorney, Agent, or Firm*—Ralf H. Siegemund

[57] ABSTRACT

A universal rolling stand has horizontally oriented rolls mounted in upper and lower roll mounts, as well as vertically oriented rolls mounted in roll mounts such that the respective axes of all rolls extend in a common plane. A biparted center frame in the stand has a plane of partitioning coinciding with the common plane. Tie rods releasably interconnect the two frame halves; slide structure on the frame halves permit therein separation in opposite directions upon release of the tie rods; and the upper and lower roll mounts are releasably mounted to the frame halves by means of additional tie rods. Upper and lower roll mounts are independently supportable upon release from the frame halves. The roll mounts can be placed on rails underneath.

6 Claims, 4 Drawing Sheets

3-4
III
1d
1b
5
8
15d
6
7
3
4
15
1a
1c

UNIVERSAL ROLL STAND

BACKGROUND OF THE INVENTION

The present invention relates to a universal stand for rolling having a horizontal and vertical rolls arranged on a common plane that extends transversely to the direction of rolling, wherein the vertical rolls as well as their respective mounts and adjusting devices are arranged in a center frame by means of which the upper and lower horizontal roll mounts are adjustable and releasable through tie rods there being a general mounting platform. Also, it is assumed that the rolls are not mounted in the usual roll housing.

The invention relates particularly to a universal roll of the variety as disclosed in German printed patent application No. 25 15 651. According to this patent the horizontal rolls are mounted in eccentric sleeves for adjusting purposes. In the case of an exchange and replacement of the rolls the biased tie rods have to be load relieved and the upper as well as lower mounts for and including the horizontal rolls themselves and also the eccentric adjusting device, all have to be removed from the tie rods by a crane or the like.

Another universal rolling mill is known through earlier German printed patent application No. 20 02 745. Herein rolls are adjusted through eccentric devices with extension pieces for application of tension and there is also a central frame which bears on a bottom plate. The adjustment is also here obtained through an eccentrical device which permits a compact frame construction and is not much subject to physical expansion, but again the short adjusting paths are nothing but a tradeoff for a disadvantageous time consuming procedure upon for exchanging and replacing rolls.

Another type of universal rolling mill with tie rod is known wherein the tie rods are rotatably mounted in the center frame for the vertical rolls. This way the upper and lower parts including horizontal roll mounts, rendered movable in vertical direction. This construction is also disadvantaged by the fact that an exchange of the rolls is rather complicated and time consuming because a frame cap has to be removed first before a roll exchange and replacement can take place which is carried out generally in upper direction. This kind of an arrangement is shown in German printed patent application No. 25 06 449.

The German Pat. No. 21 44 511 discloses a universal roll of similar kind which however is disadvantaged by a reduced stiffness of the frame owing to the tension of and in the very long unbiased tie rods.

German Pat. No. 11 29 441 discloses a universal stand which is comprised of an upper part, a center part and a lower part which are interconnected by tension rods so as to establish a unit. This kind of frame construction is simpler as compared with other known universal roll stand and is stiffer on account of smal distances between the columns in the stand. However, this kind of construction is disadvantaged by the exchange and removal of rolls since the exchange is possible only through a rather complex and time consuming removal of upper and central parts. This kind of construction, moreover, is believed to offer even more time consuming roll exchange procedures than the roll exchange in the other cases discussed earlier.

For all these situations it has to be observed that in modern mills the rolling program is changed relatively frequently and whenever the rolls have to be exchanged or replaced, then all these instances offer cumulatively an operational down time that can become quite excessive.

DESCRIPTION OF THE INVENTION

It is an object of the present invention to provide a new and improved universal rolling mill without roll housing as delineated in the introduction and which avoids the drawbacks and disadvantages of the known rolling stands.

It is a particular object of the present invention to facilitate the exchange and replacement of rolls in universal rolling mills without roll housing. The facilitation should be effective when taken advantage of on line or in a refurbishing stand.

It is a particular object of the present invention to improve universal rolling stands and frames having no roll housing but having horizontal and vertical rolls arranged in a common axial plane and wherein the mounts and adjusting devices for the vertical rolls are arranged in a central frame by means of which upper and lower horizontal roll mounts are adjustable and connected through tie rods.

In accordance with the preferred embodiment of the present invention, it is suggested to partition the central frame in a plane running transverse to the direction of rolling and wherein the two center frame parts are releasably interconnected to provide for a unit as far as taking up reaction forces is concerned. Foot stands or the like serving as gliding services are provided for shifting the two central frame parts apart whenever their connection has been released, the horizontal roll mounts are releasably connected to the frame halves and all roll mounts are arranged in the frame such that they are supported as a unit when the frame halves are separated from each other.

The transverse partitioning of the center frame for the vertical rolls in a plane running transversely to the direction of rolling itself as well as the slidability of the center frame parts when released permits to support and free the entire set of rolls including their mounts, after insertion of spacers so that the rolls including their mounts can be taken from above, out of the stand one by one. Whenever necessary for the removal of otherwise stationary rolls and their adjusting and mounting structures, it is suggested that actually the lower horizontal roll mounts are placed on rails underneath to provide and permit vertical relative motion between the roll mounts and rails, so that the rails can support the rolls whenever the center frame halves have been separated. This way it is possible to quickly move a new set of rolls into the stand shortly thereafter the previously separated center frames halves can be reconnected and the horizontal roll mounts will then quickly be connected and fastened to the center frame. The horizontal roll mounts are preferably connected (i.e. connectable) to the center frame through tie rods which are in turn mounted to the center frame to be carried along whenever the frame halves are separated. Passage ways are provided in the horizontal roll mount to permit lateral insertion and removal of the tie rods. The tie rods are comprised of standing bolts screwed into the center frame and having adjusting caps and the rotational drive for each pressure nut is carried along also be the center frame halves. The vertical roll mounts are provided with booms projecting into the center frame and adjusting devices for the vertical rolls may engage or disengage from the booms in a manner permitting them to move along with the center frame halves when separated.

The universal roll stand without roll housing in accordance with the invention was found to be quite stiff, can be designed for small dimensions, is relatively light, requires low investment and on account of the new partitioning of the center frame permits a much faster than usual exchange and replacement of the rolls.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Figure 2:
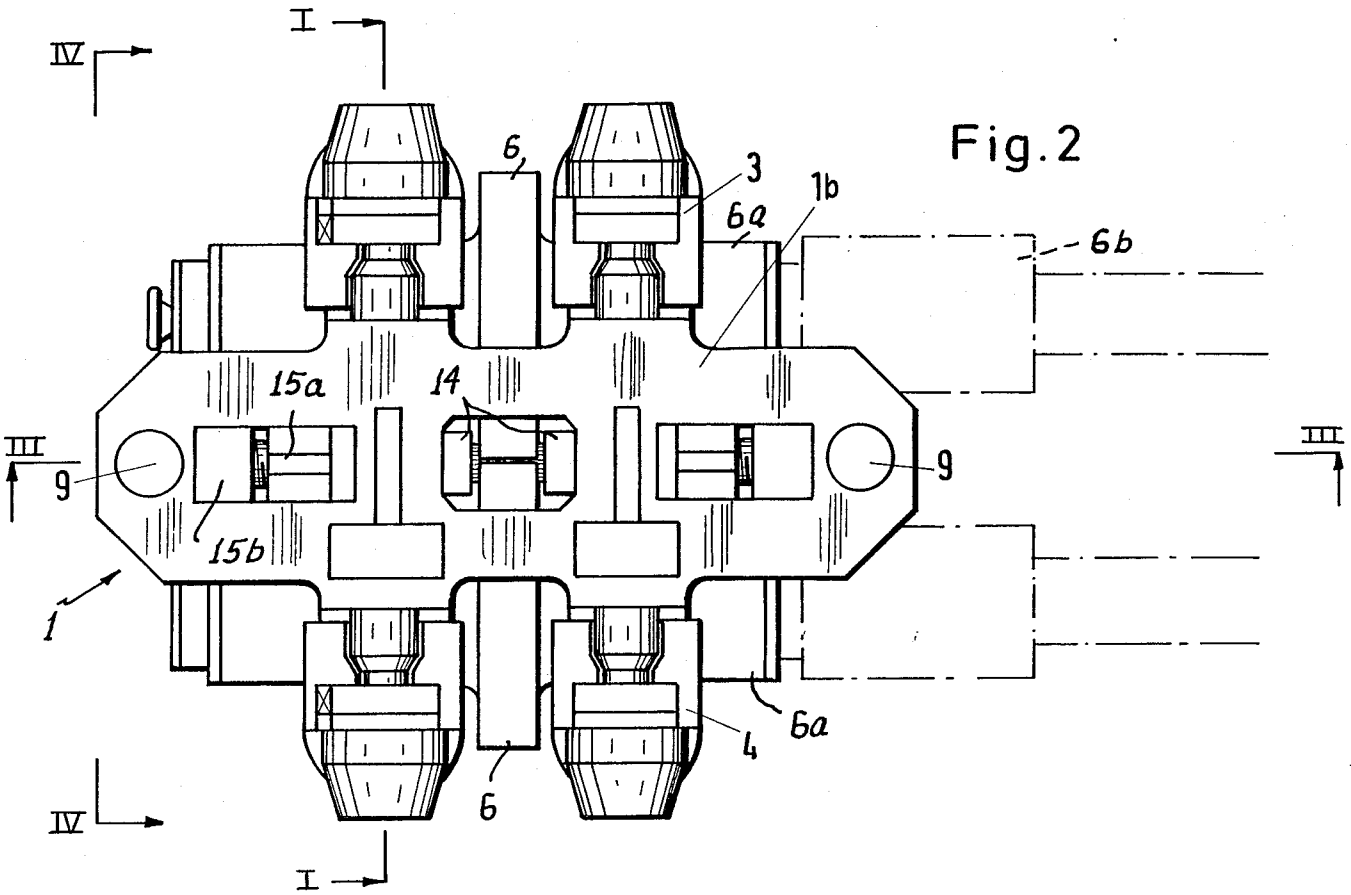
FIG. 2 is a side view of the stand in FIG. 1 as indicated by II—II in FIGS. 1 and 3.
Figure 3:
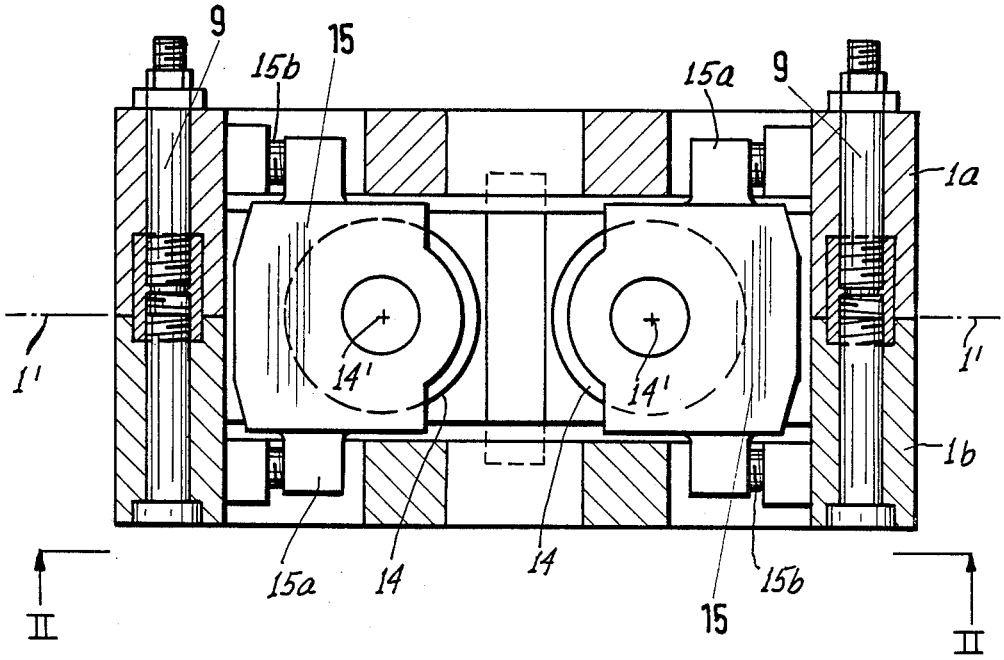
FIG. 3 is a cross section taken through line III—III in FIGS. 1, 2, and 4.

Proceeding now to the detailed description of the drawings the universal rolling frame and stand, but without roll housing, are constructed in accordance with the preferred embodiment of the present invention and include as a basic inventive element a vertically biparted center frame 1 for receiving the mounts 15 for the vertical rolls 14 (FIG. 3). The horizontal rolls 6 are on roll shafts **6*a* which are mounted in mounts 3 (upper horizontal roll) and 4 (lower horizontal roll). These shafts are driven by roll drive shaft 6*b*** (FIG. 2).

Figure 1:
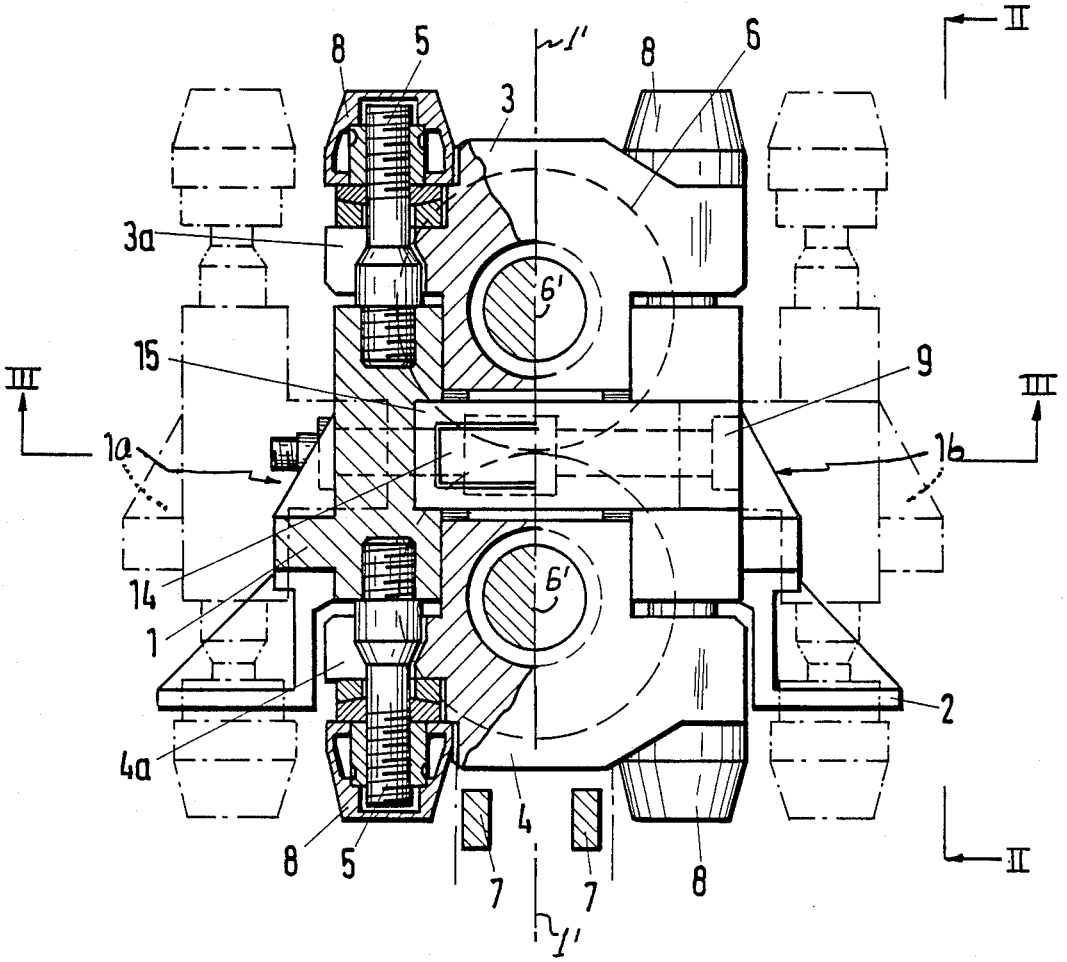
FIG. 1 is a cross section through a roll stand improved in accordance with the preferred embodiment of the present invention, the section plane being indicated by I—I in FIG. 2.

The frame 1 is partitioned in a plane indicated by 1' in FIGS. 1 and 3, and thereby providing for two frame halves; **1*a* and 1*b*. The partitioning in particular is carried out in a vertical plane running through the axes 6' of the horizontal rolls 6 (FIG. 1) as well as through the axes 14' of the vertical rolls 14 (FIG. 3). The two parts 1*a* and 1*b* of the frame are normally interconnected through biased, tie rods 9 to obtain a frame unit which as far as reaction to external forces is concerned can now be regarded as a unitary unit. Reference numeral 2 in FIG. 1** illustrates stand plates of this frame by means of which the frame halves, when removed from the stand, can be separately placed down elsewhere.

Reference numeral 3–4 defines a horizontal plane of symmetry (FIG. 4), and upper and lower roll mounts 3 and 4, respectively, are arranged symmetrically to that plane. Together as well as in conjunction with tie rods 5 they establish a system for receiving horizontal rolling forces as they appear in the horizontal rolls 6. The tie rods 5 are normally bolted to the frame 1 (FIG. 1), but can be released from the mounts 3 and 4 when the frame halves 1a and 1b are separated. The dash-dot lines for the frame halves in FIG. 1 indicate the separated state, so does FIG. 4. Upon comparing the Figures, one can see that there are alltogether eight tie rods 5.

Adjusting caps 8 are provided at the respective outer ends of the tie rods 5. These caps are adjustable in order to set the displacement for horizontal roll mounts 3 and 4 to obtain proper rolling position for the horizontal roll 6. The tie rods 5 resemble upright bolts and are carried by the frame 1 so that are being carried along when the frame halves **1*a* and 1*b*** are separated.

In order to permit the frame half separation, lateral slots **3*a* and 4*a* are provided in the mount 3 and 4 and laterally they are widened diagonally for permitting insertion and removal of the tie rods 5 particularly as frame halves are moved towards or away from each other. The vertical roll mounts 15 have booms 15*a*. The boom project into openings or windows of the frame 1 and bear against adjustment devices 15*b* on the respective halves for the vertical rolls which devices 15*b* travel along with the respective frame halves 1*a* and 1*b***.

Figure 4:
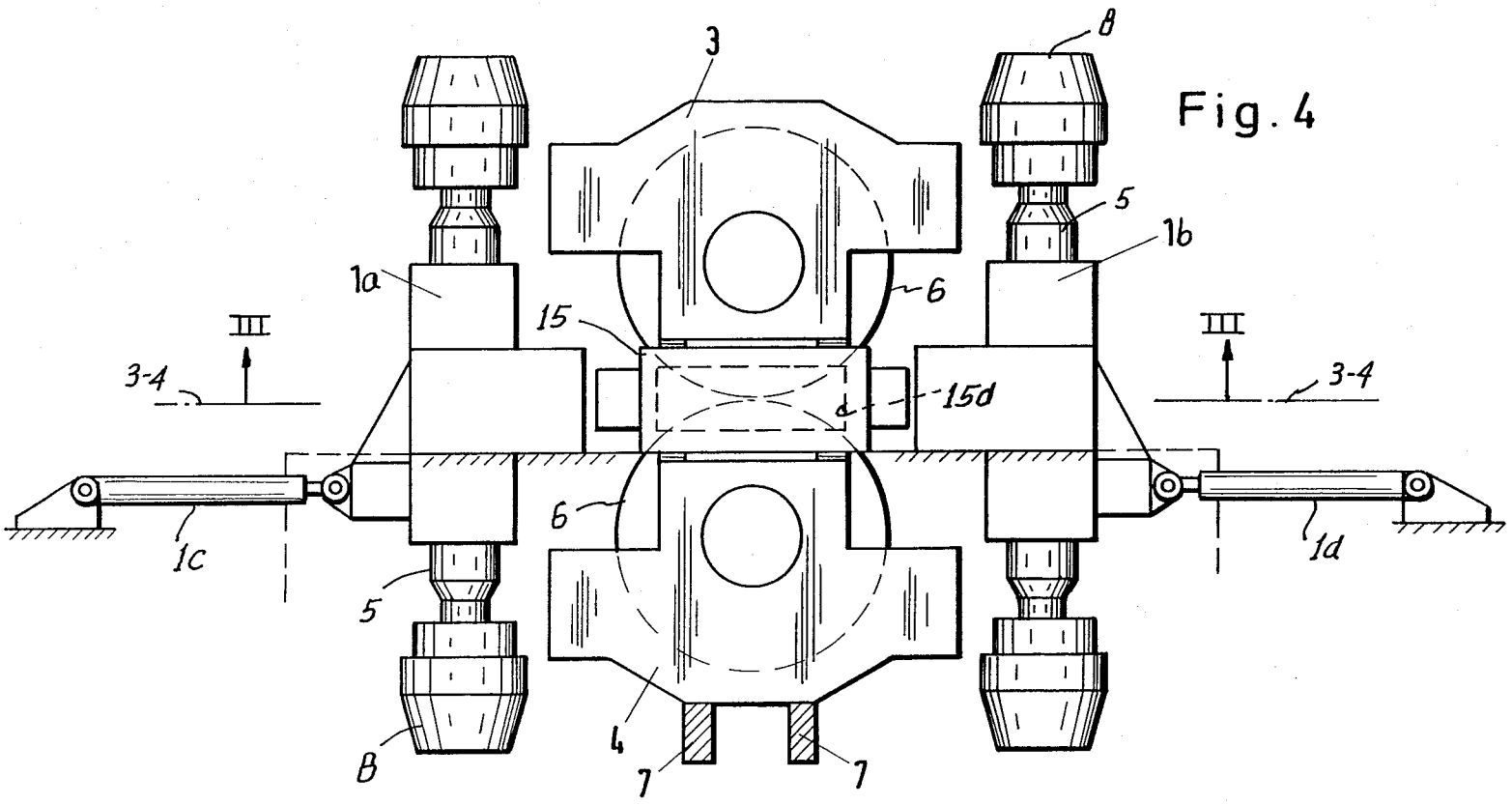
FIG. 4 is a side view as indicated by IV—IV in FIG. 2.

Rails 7 are provided underneath the lower horizontal roll mounts 4. Normally, roll mount 4 is lifted off the rails 7 (FIG. 1), but for dissassembly mount 4 can slide on these rails (FIG. 4). This requires release and separation of the frame halves **1*a*, 1*b*. Reference numerals 1*c* and 1*d*, respectively, refer to hydraulic or pneumatic drives for separating the frame halves 1*a* and 1*b* from each other. They are omitted in FIGS. 1, 2, and 3, but shown in FIG. 4**. Here the drives show retracted piston rods.

The two center frame halves **1*a* and 1*b* upon being shifted apart bear upon extensions of the stand plates 2 which extensions serve in addition as slide support surfaces. There may be similar glide surface external and away from the rolling mill proper but pertaining to a refitting stand. After the two center halves 1a,b have been slid apart the rolls (6) sitting on rail 7** are freed and can now be removed for purposes of roll exchange.

The invention is not limited to the embodiments described above, but all changes and modifications thereof, not constituting departures from the spirit and scope of the invention are intended to be included.

I claim:

1. In a universal rolling stand having horizontally oriented rolls mounted in upper and lower roll mounts, further having vertically oriented rolls mounted in roll mounts such that the respective axes of all said rolls are in a common plane, the improvement comprising:

a biparted center frame having a plane of partitioning coinciding with said common plane, there being two frame halves accordingly;

releasable first tie rods for interconnecting the two frame halves;

slide means on the frame halves permitting separation of them in opposite directions towards and away from the common plane of said roll axes upon release of said tie rods; and means for releasably mounting said upper and lower roll mounts to said frame halves, said upper and lower roll mounts being independently supportable upon release from the frame halves.

2. The improvement as in claim 1, there being rail means underneath said lower roll mount.

3. The improvement as in claim 1, said means for releasably mounting being second tie rods connected to the frame halves and moving therewith upon disengagement from the upper and lower roll means.

4. The improvement as in claim 3, said upper and lower roll mounts having lateral passage ways for entry and removal of the second tie rods.

5. The improvement as in claim 3, said second tie rods being upright bolts threaded into the frame and having adjusting heads.

6. The improvement as in claim 1, the vertical roll mounts having laterally extending booms, there being adjusting means on the frame halves moving therewith for disengagement from and engagement with said booms.

* * * * *